United States Patent [19]

Gustafsson

[11] 4,047,330

[45] Sept. 13, 1977

[54] BARRIER FOR MOPEDS AND BICYCLES

[76] Inventor: Inge Charlen Gustafsson, Skyttevagen 10, S-290 71 Morrum, Sweden

[21] Appl. No.: 659,054

[22] Filed: Feb. 18, 1976

[51] Int. Cl.[2] ..... E05D 15/02

[52] U.S. Cl. ..... 49/42; 49/49; 256/1

[58] Field of Search ..... 49/42, 49, 35; 256/1, 256/60

[56] References Cited

U.S. PATENT DOCUMENTS

| | | | |
|---|---|---|---|
| 841,696 | 1/1907 | Lang | 49/49 |
| 1,101,860 | 6/1914 | Lsngslow | 256/1 |
| 1,186,945 | 6/1916 | Richards | 49/49 X |
| 2,309,893 | 2/1943 | Gersbach | 49/49 X |

*Primary Examiner*—Kenneth Downey

[57] ABSTRACT

In a barrier for bicycles of selected lengths there is provided a U-shaped obstructing unit and means at the open side of such unit preventing in cooperation with the unit the passage of bicycles of a predetermined length.

4 Claims, 3 Drawing Figures

BARRIER FOR MOPEDS AND BICYCLES

This invention relates to a barrier for bicycles of selected dimensions.

To exclude moped and bicycle traffic from paths, playgrounds, greens and other places where such traffic is not desired is frequently found to be a great problem.

In order to solve this problem there is provided according to the invention a barrier for bicycles of selected dimensions comprising in combination two end walls, a side wall interconnecting the two end walls along one side and forming a unit therewith, means mounting said unit at the side wall thereof with the unit spaced above the ground, and means on the open side of said unit compelling a bicycle seeking to pass through the barrier, to pass on the inside of said means between the two endwalls distance between the two end walls and said means being so selected to prevent the passage of bicycles of a predetermined length.

A preferred embodiment of the invention comprises a barrier for mopeds only or for mopeds as well as conventional bicycles, wherein said unit comprises two bows which are arranged substantially horizontally one above the other the webs thereof forming said side wall and the legs thereof forming said end walls, and are interconnected at the ends of the legs, opposite the webs, wherein said mounting means comprises a supporting pole the bows being mounted at their webs to said supporting pole, and wherein said compelling means comprises a second pole spaced from said supporting pole.

In order to allow a pedestrian with a baby-carriage to pass through the barrier the distance between the legs of the upper bow preferably is made greater than the distance between the legs of the lower bow.

If said unit is pivoted to the supporting means a pedestrian may pass the barrier along a straight line.

Further features and details of the invention will be apparent from the following description of an illustrative embodiment of a barrier for mopeds and bicycles according to the invention reference being made to the accompanying drawing wherein FIG. 1 is a side elevational view of the barrier according to the invention;

Figure 1:
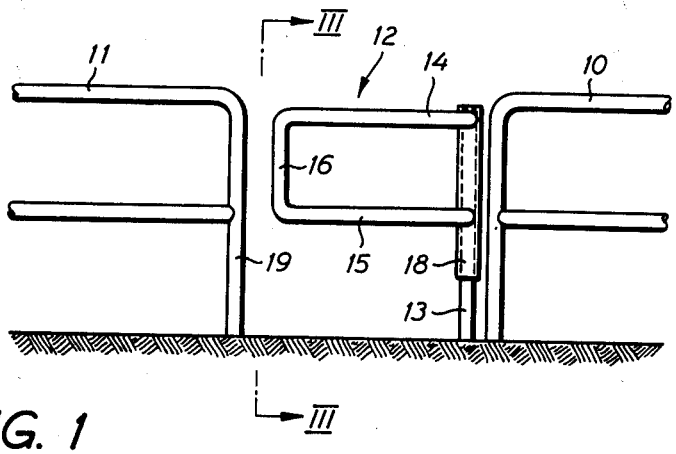
Figure 2:
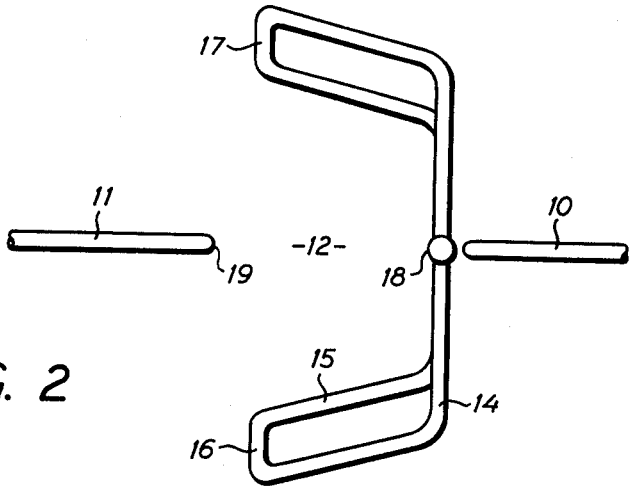
FIG. 2 is a plan view of the barrier.
Figure 3:
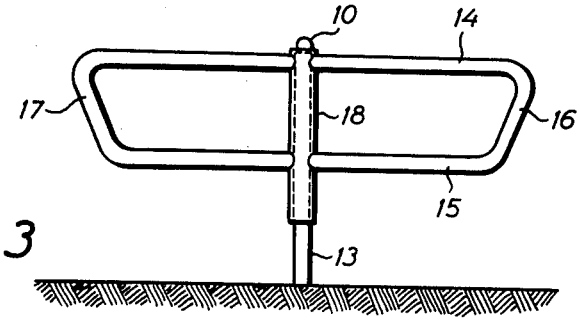
FIG. 3 is a cross sectional view along line III—III in FIG. 1.

Between two portions 10 and 11 of a fence of tube or suitably profiled bar material there is arranged a passage 12. On a supporting pole 13 close to fence portion 10 there is mounted an obstructing unit consisting of two U-formed bows of tube or bar material, namely an upper bow 14 and a lower bow 15 said bows being arranged substantially horizontally one above the other and being interconnected by means of portions 16 and 17 which may be formed integrally with the two bows. The lower bow 15 has a shorter spacing between the legs thereof than the upper bow 14 so that portions 16 and 17 are inclined as will be seen from FIG. 3. The legs of each bow may or may not diverge from the web of the bow as disclosed here. The legs of the two bows form two end walls and the webs thereof form a side wall interconnecting the two end walls along one side of the U-shaped obstructing unit 14–17. At the centre of their webs the bows are interconnected by means of a tube 18 at which the unit formed by the bows is mounted to supporting pole 13 the unit being spaced above the ground. Preferably, said unit is pivoted to this supporting pole but it may also be fixedly connected therewith. The supporting pole may be arranged as the end pole of fence portion 10.

End pole 19 of fence portion 11 forms a functional element of the barrier. It is disposed on the open side of the U-shaped obstructing unit opposite supporting pole 13 in a common vertical plane of fence portions 10 and 11 and in the embodiment shown and described it is spaced from pole 13 at a distance preventing a person to pass through passage 12 on the inside of pole 13 between the legs or side walls of the U-shaped obstructing unit 14–17 with a moped or a bicycle while a pedestrian easily can walk through passage 12 of the fence without being impeded by the barrier. However, in some cases it may be desired to allow a person to pass with a bicycle but not with a moped for example where a bicycle track ends at a street or road where there is a heavy traffic. This can be achieved by increasing the distance between end pole 19 and supporting pole 13.

Since the barrier according to the invention may be arranged so as to form a curved passage it is possible to achieve by this barrier that the person passing through the barrier will be retarded and will arrive at a connecting traffic route along or against the driving direction thereon, the specific direction being dependent on what is desired in the actual case. Thus, the barrier according to the invention allows a selective passage therethrough and moreover retards and guides the person during the passage in a favourable way considering the safety in traffic.

In the embodiment shown and described the distance between the legs of the lower bow 15 is made shorter than the distance between the legs of the upper bow 14, and this provides the advantage that also a pedestrian with a baby-carriage can pass through the barrier without being impeded. The arrangement is based on the fact that a moped or bicycle is longer than baby-carriages at a certain height over the ground level. That is the baby-carriage has its shortest length immediately above the wheels, the moped or bicycle having the largest length thereof at the corresponding level.

The pivoted mounting of the bow unit provides the possibility to make the distances between portions 16 and 17 on one side and between poles 13 and 19 on the other side shorter without interfering with the passage of pedestrians. The bow unit may be swung towards one side or other on supporting pole 13 against pole 19 or to a position close to pole 19, and then passage may take place along a straight line which means that the pedestian need not deviate from the walking course.

What I claim is:

1. A barrier for selectively passing vehicles such as baby carriages of predetermined height or length while barring vehicles such as bicycles of differing height or greater length, comprising, in combination, two substantially U-shaped bows which are arranged substantially horizontally, one above the other, each bow having two legs, and a web fixedly interconnecting the two legs along one side and forming a substantially U-shaped rigid unit therewith, the legs being interconnected at their ends opposite the webs so that the bows are united in one piece; and the distance between the legs of one bow being greater than the distance between the legs of the other bow; a supporting pole mounting substantially U-shaped unit at the webs thereof with the substantially U-shaped unit spaced above the ground; and a second pole spaced from said supporting pole on the open side of said unit and embraced by the legs of the bows; the substantially U-shaped unit and the second pole defining therebetween an open passageway through the barrier, and compelling a vehicle seeking to pass through the passageway to pass on the inside of said second pole between the web and two legs, the distance between the two legs and web and said second pole being so selected as to permit the passage therethrough of vehicles such as baby carriages of a predetermined height or length, while preventing passage therethrough of vehicles such as bicycles of differing height or lesser length.

2. A barrier as claimed in claim 1 wherein said supporting pole and said second pole are disposed in a vertical plane extending substantially centrally through the bows.

3. A barrier as claimed in claim 1 wherein the legs of each bow diverge from the web thereof.

4. A barrier as claimed in claim 1 wherein said substantially U-shaped unit is pivotably mounted on the supporting pole substantially at the center of the bow webs, for movement within a limited arc extending at most to abutment of the U-shaped unit with the second pole.

* * * * *